US010424870B2

(12) United States Patent
Kanda et al.

(10) Patent No.: US 10,424,870 B2
(45) Date of Patent: Sep. 24, 2019

(54) CONNECTOR WITH A LOCK ARM

(71) Applicant: YAZAKI CORPORATION, Tokyo (JP)

(72) Inventors: Hidenori Kanda, Shizuoka (JP); Hiromasa Kubota, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/696,468

(22) Filed: Sep. 6, 2017

(65) Prior Publication Data

US 2018/0076566 A1 Mar. 15, 2018

(30) Foreign Application Priority Data

Sep. 12, 2016 (JP) ..... 2016-177773

(51) Int. Cl.
*H01R 13/629* (2006.01)
*H01R 13/52* (2006.01)
*H01R 13/627* (2006.01)

(52) U.S. Cl.
CPC ..... *H01R 13/62966* (2013.01); *H01R 13/52* (2013.01); *H01R 13/5216* (2013.01); *H01R 13/6272* (2013.01); *H01R 13/6271* (2013.01); *H01R 13/6275* (2013.01)

(58) Field of Classification Search
CPC ..... H01R 13/6271; H01R 13/6275
USPC ..... 439/352, 358
See application file for complete search history.

(56) References Cited

U.S. PATENT DOCUMENTS 7,056,142 B2 * 6/2006 Ueda ..... H01R 13/6272 439/328
7,267,570 B2 * 9/2007 Fry, Jr. ..... H01R 13/6272 439/357
7,883,350 B2 * 2/2011 Byrnes ..... H01R 13/6273 439/157

(Continued)

FOREIGN PATENT DOCUMENTS

CN 102694295 A 9/2012
CN 106030929 A 10/2016

(Continued)

OTHER PUBLICATIONS

Chinese Office Action for the related Chinese Patent Application No. 201710819137.3 dated Dec. 5, 2018.
Japanese Office Action for the related Japanese Patent Application No. 2016-177773 dated Oct. 23, 2018.
Japanese Office Action for the related Japanese Patent Application No. 2016-177773 dated Feb. 12, 2019.
Chinese Office Action for the related Chinese Patent Application No. 201710819137.3 dated Apr. 16, 2019.

(Continued)

*Primary Examiner* — Tho D Ta
*Assistant Examiner* — Marcus E Harcum
(74) *Attorney, Agent, or Firm* — Kenealy Vaidya LLP

(57) ABSTRACT

A connector includes a housing and a lock arm that extends from the housing and is engageable with a counterpart connector. The lock arm includes a first arm a has a shape of a cantilever beam and has a locking hole for being engaged with the counterpart connector at a free end side of the first arm, and a second arm that extends from an end portion on the free end side of the first arm and is capable of releasing the engagement by bending the first arm around a fixing end of the first arm. The locking hole has a hole of which the size in a width direction orthogonal to an extending direction of the first arm becomes larger as a measurement position of the size of the hole gets closer to the free end from the fixing end.

7 Claims, 7 Drawing Sheets

(56) References Cited

U.S. PATENT DOCUMENTS

| | | | | |
|---|---|---|---|---|
| 8,337,235 | B2 * | 12/2012 | Mizutani | H01R 13/6272 439/352 |
| 8,882,528 | B2 * | 11/2014 | Sasho | H01R 13/6335 439/358 |
| 2001/0001750 | A1 * | 5/2001 | Kawase | H01R 13/6272 439/489 |
| 2001/0035652 | A1 | 11/2001 | Wada et al. | |
| 2004/0005805 | A1 * | 1/2004 | Shibata | H01R 13/5219 439/358 |
| 2004/0142591 | A1 * | 7/2004 | Yamawaki | H01R 13/6272 439/358 |
| 2008/0153341 | A1 * | 6/2008 | Shigeta | H01R 13/6272 439/352 |
| 2009/0255596 | A1 * | 10/2009 | Leys | B01F 5/0077 137/606 |
| 2012/0219357 | A1 | 8/2012 | Mizutani et al. | |
| 2014/0087580 | A1 | 3/2014 | Sugimoto | |
| 2014/0179146 | A1 | 6/2014 | Hamai et al. | |
| 2017/0018874 | A1 | 1/2017 | Kida | |

FOREIGN PATENT DOCUMENTS

| | | | | |
|---|---|---|---|---|
| JP | 2001-250636 | A | 9/2001 | |
| JP | 2012-195285 | A | 10/2012 | |
| JP | 2013-58358 | A | 3/2013 | |
| JP | WO 2013035886 | A1 * | 3/2013 | H01R 13/6272 |
| JP | 2014-67517 | A | 4/2014 | |
| JP | 2015-195126 | A | 11/2015 | |
| WO | 2015/151889 | A1 | 10/2015 | |

OTHER PUBLICATIONS

Japanese Reconsideration Report by Examiner before Appeal for the related Japanese patent application No. 2016-177773 dated Jun. 12, 2019.

Japanese Notice of Terminaton of Reconsideration by Examiners before Appeal Proceedings for the related Japanese patent application No. 2016-177773 dated Jun. 14, 2019.

* cited by examiner

CONNECTOR WITH A LOCK ARM

CROSS REFERENCE TO RELATED APPLICATION

This application is based on Japanese Patent Application No. 2016-177773 filed on Sep. 12, 2016, the contents of which are incorporated herein by reference.

BACKGROUND OF THE INVENTION

1. Technical Field

The present invention relates to a connector including a housing and a lock arm which extends from the housing and is engageable with a counterpart side connector.

2. Background Art

From the related art, a connector including a lock arm which is engageable with a counterpart side connector is suggested (for example, JP-A-2015-195126 and JP-A-2001-250636).

For example, a lock arm included in one of the connectors of the related art (hereinafter, referred to as "connector of the related art") includes: an engaging arm which has a shape of a cantilever beam and has a locking hole for being engaged with a counterpart side connector in the vicinity of a free end; and a releasing arm which extends from an end portion on the free end side of the engaging arm.

The connector of the related art is fixed to the counterpart side connector by locking the locking hole of the lock arm to a locking piece of the counterpart side connector. Furthermore, the connector of the related art releases engagement of the locking hole and the locking piece by separating the engaging hole and the locking piece of the counterpart side connector from each other by operating the releasing arm and bending the engaging arm around a fixing end (for example, refer to JP-A-2015-195126).

In the connector of the related art, when an operator performs the above-described engagement releasing, the operator applies an external force to the releasing arm, and the engaging arm is bent (deformed) by the external force around the fixing end. In the connector having such a mechanism of engagement releasing, when a part having extremely small strength exists between an operation portion (a part to which the operator applies the force) of the releasing arm and the fixing end of the engaging arm, there is a possibility that the part is preferentially bent (deformed) and the engaging arm is not bent (deformed) as assumed. In this case, even when the external force to an extent that the engagement is released when the engaging arm is bent (deformed) as assumed is applied to the releasing arm, there is a possibility that the engagement is not released. That is, the operability when performing the engagement releasing may deteriorate.

In particular, in the connector of the related art, since a sectional area of the lock arm in the periphery of the locking hole is small, it is considered that the strength of the lock arm deteriorates in the periphery of the locking hole. However, in a case where the locking piece of the counterpart side connector is sufficiently small and the locking hole of the lock arm is also sufficiently small, practically, it is possible to ignore the above-described deterioration of strength. Meanwhile, as the size of the locking piece of the counterpart side connector increases, the size of the locking hole of the lock arm also increases, and there is a concern about the above-described deterioration of strength (or deterioration of operability of the engagement releasing).

The invention has been made in consideration of the above-described problem, and an object thereof is to provide a connector which can maintain operability of engagement releasing as much as possible even when the size of a locking piece of a counterpart side connector is large.

SUMMARY OF THE INVENTION

In order to achieve the above object, a connector according to the invention is characterized as following (1) and (2) below.

(1) A connector includes a housing and a lock arm that extends from the housing and is engageable with a counterpart connector. The lock arm includes a first arm that has a shape of a cantilever beam and has a locking hole for being engaged with the counterpart connector at a free end side of the first arm, and a second arm that extends from an end portion on the free end side of the first arm and is capable of releasing the engagement by bending the first arm around a fixing end of the first arm. The locking hole has a hole of which the size in a width direction orthogonal to an extending direction of the first arm becomes larger as a measurement position of the size of the hole gets closer to the free end from the fixing end.

(2) In the connector of (1), the lock arm is formed of a hydrolysis-resistant material.

According to the connector having the above-described configuration (1), the locking hole has the hole shape (hole width enlarging portion) of which the size in the width direction orthogonal to the extending direction of the first arm (engaging arm) increases at least at a part as approaching the free end from the fixing end of the first arm (engaging arm). Therefore, for example, when a part example, an end portion on the free end side) of the locking hole is a part having a hole width which corresponds to the size of the locking piece of the counterpart side connector, and the other part the hole width enlarging portion (that is, when the hole width decreases as being separated from the end portion on the free end side), compared to a case where the entire locking hole is the former (which has a hole width that corresponds to the size of the locking piece of the counterpart side connector), and it is possible to prevent deterioration of strength in the periphery of the locking hole as much as the sectional area of the first arm can be maintained.

Therefore, the connector having the above-described configuration can maintain operability of the engagement releasing as much as possible even when the size of the locking piece of the counterpart side connector is large.

Furthermore, the connector having the above-described configuration also has other effects. Specifically, according to the connector having the above-described configuration, flexibility of the first arm (engaging arm) by the hole width enlarging portion gradually changes depending on the place (that is, a stress is diffused when bending the first arm). Therefore, when performing the engagement releasing, concentration of stress is mitigated in the periphery or the like of the fixing end of the first arm (engaging arm), and further, according to the connector having the above-described configuration, when a widening degree (inclination angle) of the hole width of the hole width enlarging portion is adjusted, it is possible to arbitrarily adjust the strength of the first arm (engaging arm). Therefore, when adjusting the widening degree (inclination angle) of the hole width in accordance with the size of the locking piece of the counterpart side connector, it is possible to maintain operability of the engagement releasing regardless of the size of the locking piece of the counterpart side connector.

According to the connector having the above-described configuration (2), the lock arm which is elastically deformed when performing the engagement and the engagement releasing is formed of a hydrolysis-resistant material. Therefore, it is possible to prevent damage of the lock arm which is particularly likely to be damaged (for example, breakage caused by the external force when performing the engagement releasing) due to deterioration caused by the hydrolysis of the configuration material. As a result, the connector having the configuration can prevent the damage of the lock arm even in a case of being used for a long period of time under a high-temperature and high-humidity environment compared to a case where the lock arm is not formed of the hydrolysis-resistant material.

In addition, the hydrolysis-resistant material which is used in the connector may be a material having excellent hydrolysis resistance, and a specific composition or the like is not particularly limited. For example, as the hydrolysis-resistant material, a composite material obtained by adding glass fibers to PBT can be used. However, PBT is a polyester resin, and depending on the use environment, the hydrolysis caused by the moisture in the environment and a hydroxyl group and an ester bond in a molecular framework of PBT, can be generated. Here, in the above-described composite material, it is preferable that PBT to which processing of improving the hydrolysis resistance is performed is used (for example, PBT-GF15). In addition, an example of processing of improving the hydrolysis resistance includes processing of substituting a hydroxyl radical (—OH) in a carboxyl end group (—COOH) which influences the hydrolysis of PBT for other atoms and molecules that show the hydrolysis resistance (for example, refer to JP-A-2006-104363 and JP-A-H8-208816).

According to the invention, it is possible to provide a connector which can maintain operability of engagement releasing even when the size of the locking piece of the counterpart side connector is large.

Above, the invention was briefly described. Furthermore, by thoroughly reading the aspects (hereinafter, referred to as "embodiments") for realizing the invention which will be described hereinafter with reference to the attached drawings, specific contents of the invention will become more apparent.

DETAILED DESCRIPTION OF EMBODIMENTS

Embodiments

Figure 1:
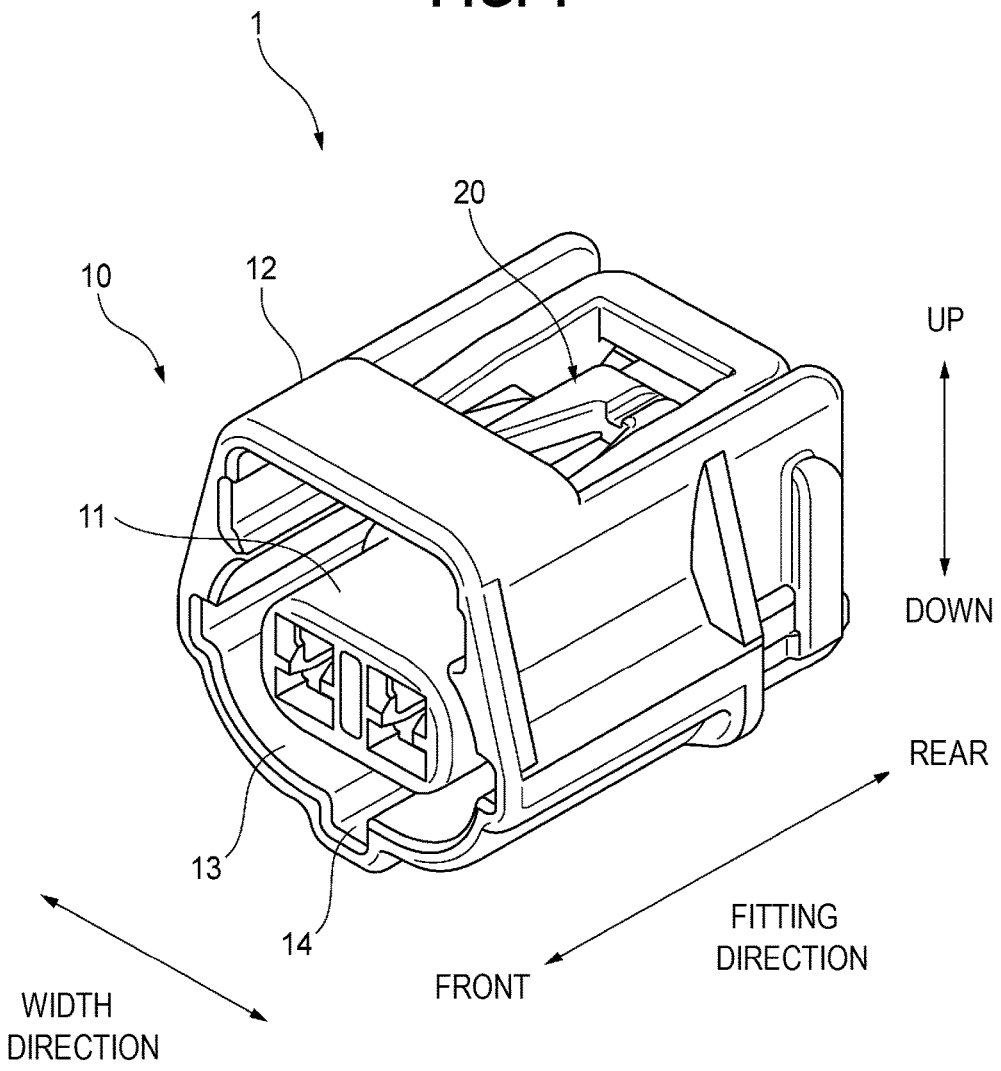
FIG. 1 is a schematic perspective view illustrating a configuration of a connector according to an embodiment of the invention.
Figure 2A:
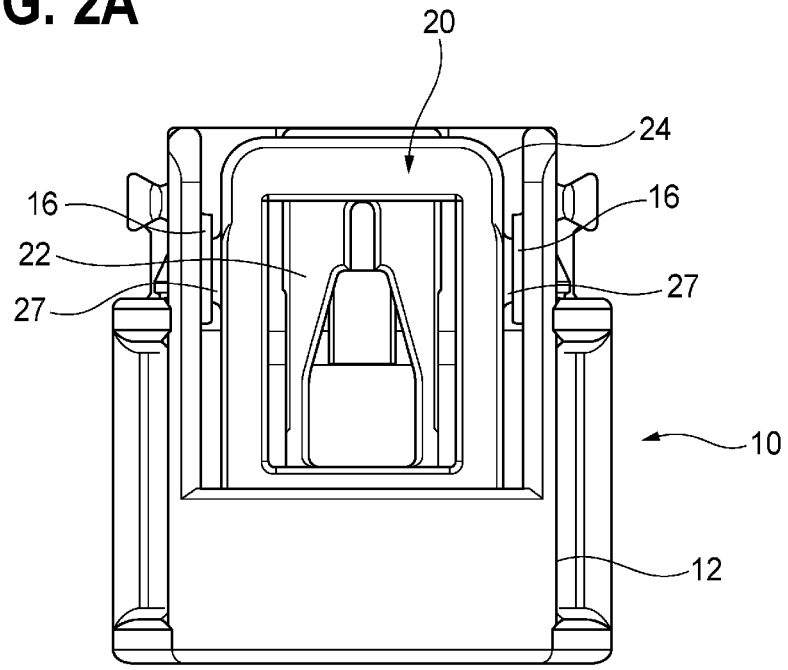
FIG. 2A is an upper view of the connector illustrated in FIG. 1.
Figure 2B:
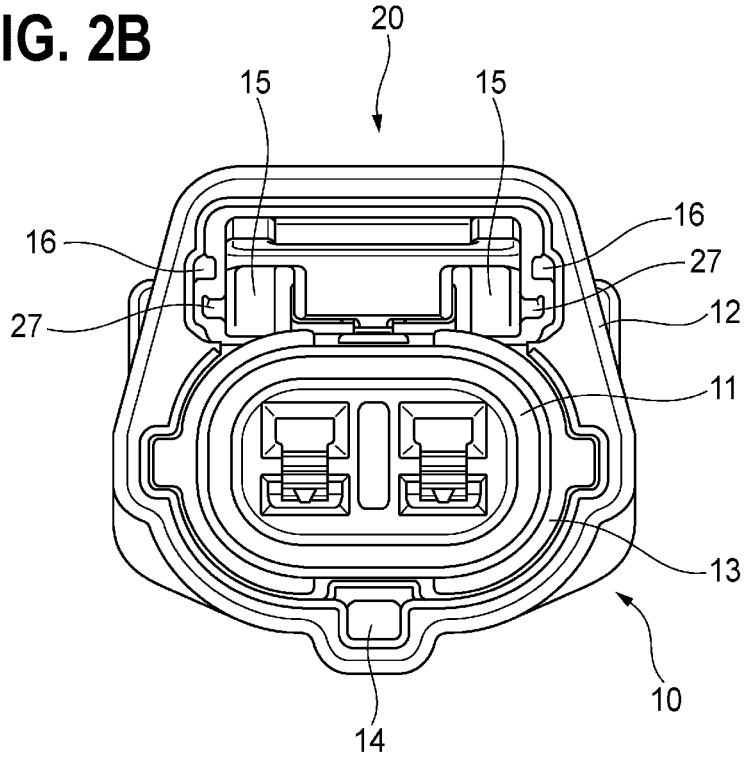
FIG. 2B is a front view of the connector illustrated in FIG. 1.

Hereinafter, a connector according to an embodiment of the invention will be described with reference to the drawings.

As illustrated in FIGS. 1 to 29, a connector 1 according to the embodiment of the invention includes a housing 10 and a lock arm 20 which extends from the housing 10. In a state where fitting of the connector 1 and a counterpart side connector 2 (refer to FIG. 6) is completed, the lock arm 20 achieves a function of maintaining a state where the lock arm 20 is engaged with the counterpart side connector 2 and the fitting of both connectors is completed.

The connector 1 (the housing 10 and the lock arm 20) is integrally molded by using a resin material made of a hydrolysis-resistant material. Specifically, by using a composite material (for example, PBT-GF15 or the like obtained by adding 15% by weight of glass fibers to PBT) obtained by adding glass fibers to PBT (polybutylene terephthalate), the connector 1 is molded to be integrated by injection molding or the like. The composite material is subjected to processing of improving the hydrolysis resistance with respect to PBT which is a base polymer. In addition, an example of processing of improving the hydrolysis resistance includes processing of substituting a hydroxyl radical (—OH) in a carboxyl end group (—COOH) which influences the hydrolysis resistance of PBT for other atoms and molecules that show the hydrolysis resistance. In addition, the hydrolysis-resistant material used in the connector 1 is not limited to the composite material, and other materials having hydrolysis resistance may be used.

Figure 3:
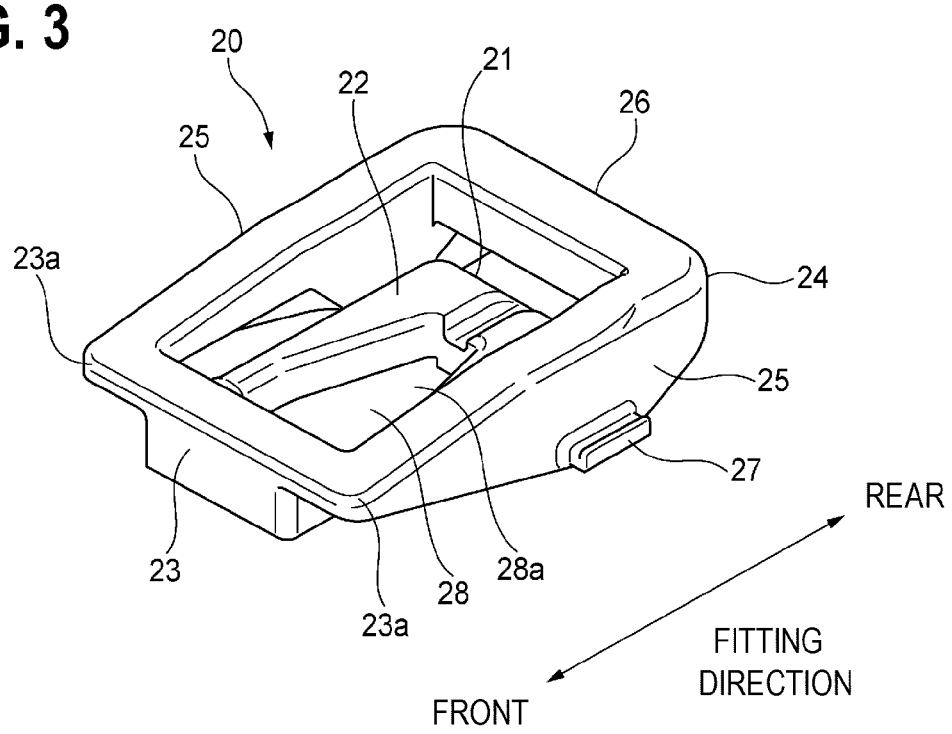
FIG. 3 is a perspective view in which a lock arm included in a housing of the connector illustrated in FIG. 1 is enlarged.
Figure 6:
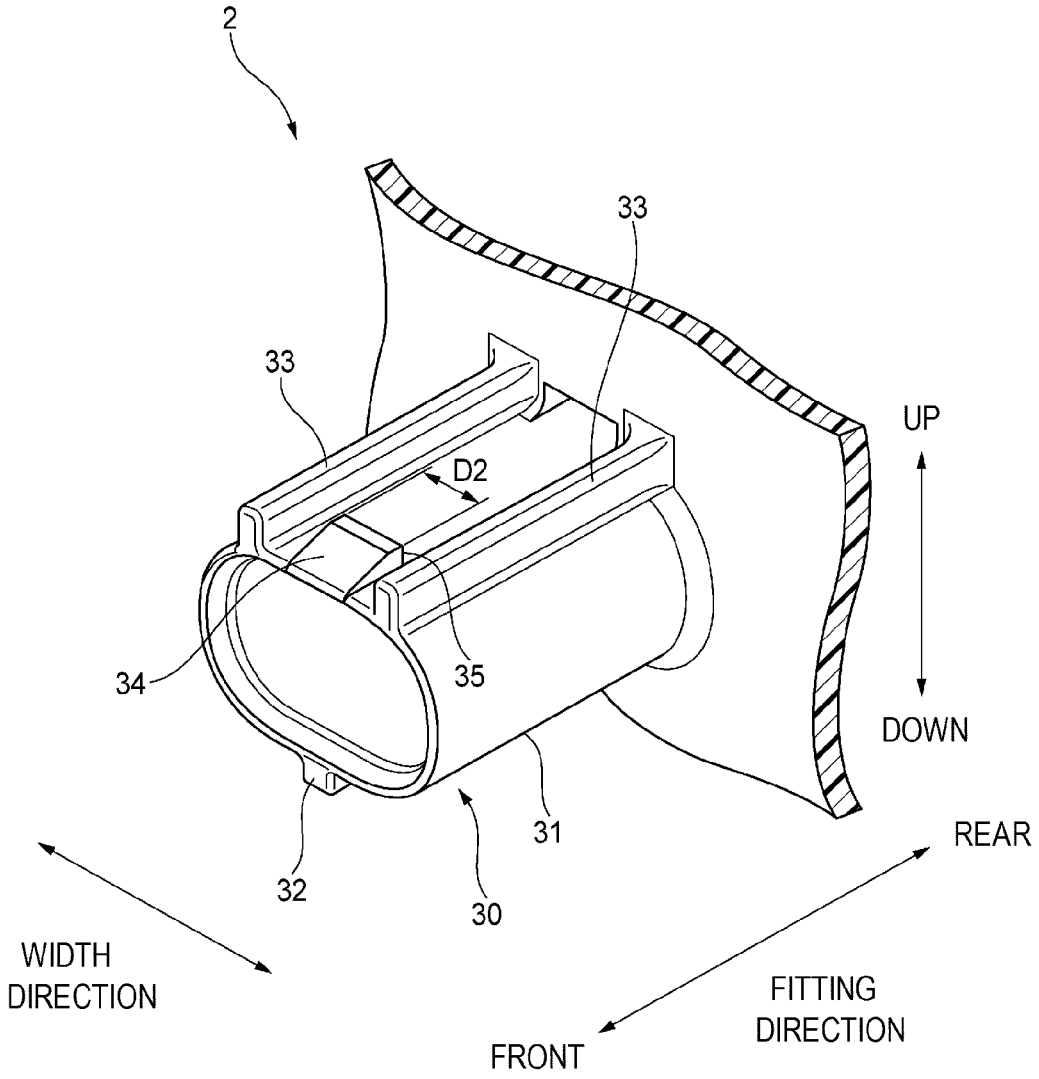
FIG. 6 is a schematic perspective view illustrating a configuration of a counterpart side connector fitted to the connector illustrated in FIG. 1.

Hereinafter, for convenience of the description, as illustrated in FIGS. 1, 3, and 6, "fitting direction", "width direction", "upward-and-downward direction", "front", "rear", "up", and "down" are defined. "Fitting direction", "width direction", and "upward-and-downward direction" are orthogonal to each other.

As illustrated in FIGS. 1 to 23, the housing 10 includes a terminal accommodation portion 11 which accommodates a terminal (not illustrated), and a hood portion 12 which has a shape of a tube that surrounds the periphery of the terminal accommodation portion 11. The terminal accommodation portion 11 has a shape of a substantial column which extends along the fitting direction.

The hood portion 12 defines an annular void 13 into which a tubular portion 31 (refer to FIG. 6) of a housing 30 of the counterpart side connector 2 is inserted, in the periphery of the terminal accommodation portion 11. The hood portion 12 covers an outer circumference of the tubular portion 31 inserted into the void 13. In the tubular portion 31 of the counterpart side connector 2, a guide rib 32 which extends in the fitting direction is provided in a center portion in the width direction of the lower surface, and one pair of guide ribs 33 which extend in the fitting direction are provided on both end sides in the width direction of an upper surface thereof (refer to FIG. 6).

The hood portion 12 includes a guide groove 14 which is disposed corresponding to the guide rib 32 of the counterpart side connector 2 and extends in the fitting direction, and one pair of spaces 15 (refer to FIG. 2B) which are disposed corresponding to the pair of guide ribs 33 and extends in the fitting direction. When the tubular portion 31 is inserted into the void 13 (that is, when the connector 1 and the counterpart side connector 2 are fitted to each other), the guide rib 32 is inserted into the guide groove 14, and the guide rib 33 is inserted into the space 15.

Figure 4A:
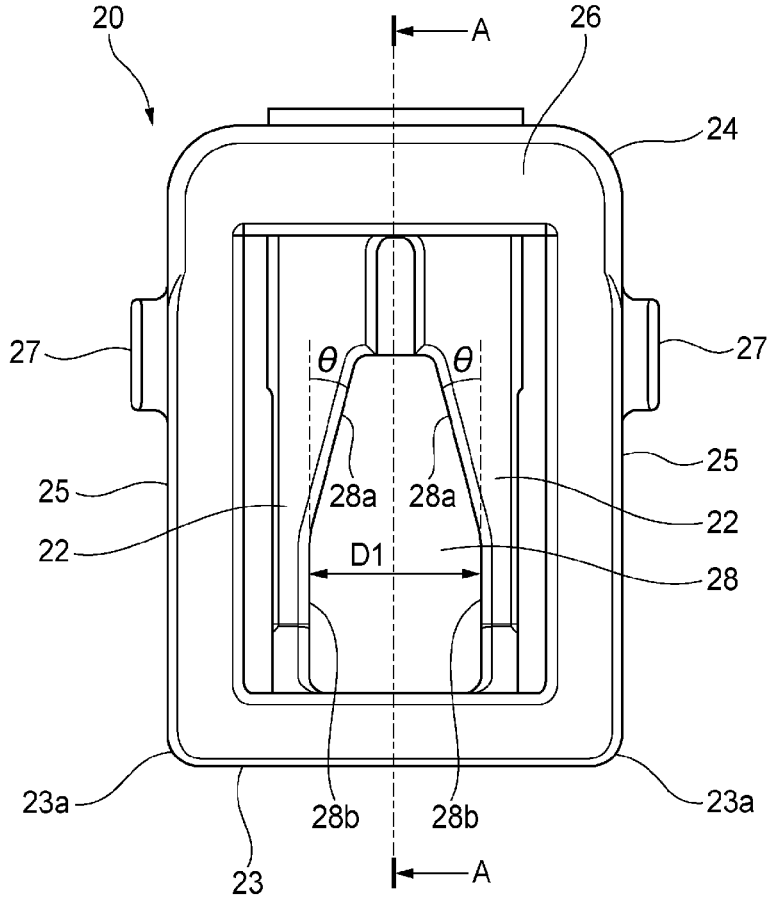
FIG. 4A is an upper view of the lock arm illustrated in FIG. 3.
Figure 4B:
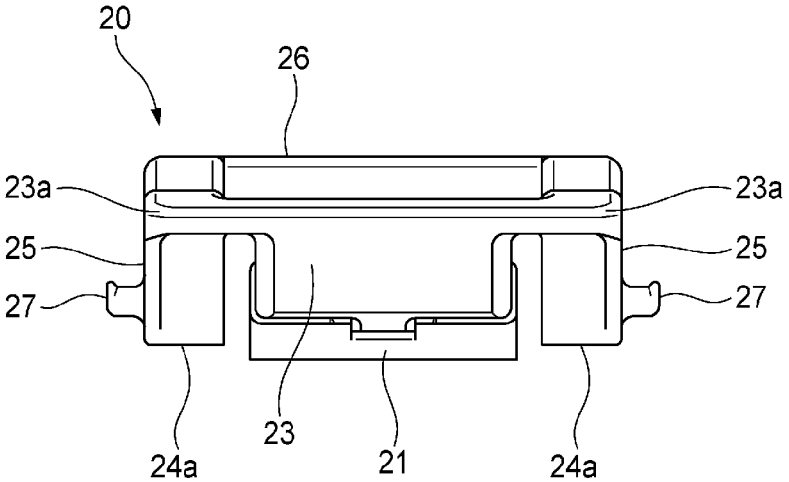
FIG. 4B is a front view of the lock arm illustrated in FIG. 3.
Figure 5:
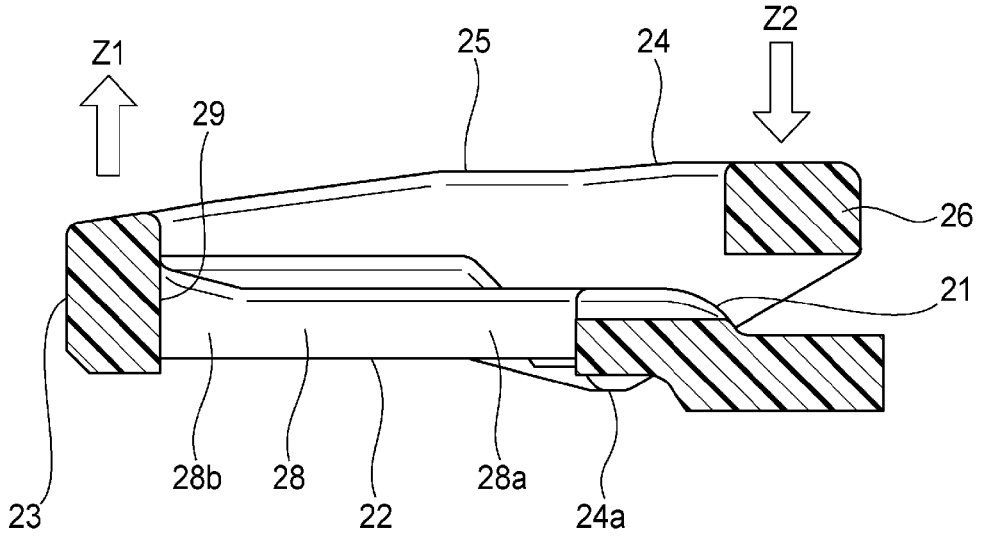
FIG. 5 is a sectional view taken along a line A-A of FIG. 4A.

As illustrated in FIGS. 3 to 5, the lock arm 20 includes an engaging arm 22 having a shape of a substantially flat plate which extends in a shape of a cantilever beam toward a front side along the fitting direction from a fixing end 21 positioned in an upper portion on a rear end side of the terminal accommodation portion 11, and a releasing arm 24 which extends in a shape of a cantilever beam toward the rear side along the fitting direction from a free end 23 of the engaging arm 22.

The releasing arm 24 includes one pair of linking arm portions 25 which extend to the rear side along the fitting direction from both end portions 23*a* in the width direction of the end portion including the free end 23, an operation portion 26 which links rear end portions of the pair of linking arm portions 25 to each other, and one pair of stoppers 27 which protrude to an outer surface of the pair of linking arm portion 25. Below the linking arm portion 25, a void for allowing displacement of the linking arm portion 25 is ensured.

In the engaging arm 22, a locking hole 28 (through hole) is provided. As will be described later, a locking surface 29 of the locking hole 28 locks a locking surface 35 of a lock projection 34 provided between the pair of guide ribs 33 on the upper surface of the tubular portion 31 of the counterpart side connector 2 in a state where the filling is completed (refer to FIGS. 6 and 7).

As illustrated in FIGS. 4A and 4B, the locking hole 28 is configured of a hole width enlarging portion 28*a* which configures a part on the rear side of the locking hole 28, and a constant hole width portion 28*b* which configures a part on the front side of the locking hole 28. The hole width enlarging portion 28*a* has a hole side surface (that is, a trapezoidal shape) inclined only by an angle θ with respect to the fining direction such that the hole width gradually increases toward the front end side from the rear end side. The constant hole width portion 28*b* has a substantially constant rectangular shape of which the hole width is a width D1. The width D1 is a value (specifically, a value which is slightly greater than D2) which corresponds to the width D2 (refer to FIG. 6) of the lock projection 34.

An end face on the rear side of the hole width enlarging portion 28*a* is positioned slightly further on a rear end side than the center position in the fitting direction of the engaging arm 22. The end face (locking surface 29, refer to FIG. 5) on the front side of the constant hole width portion 28*b* is positioned in the vicinity of the free end 23 of the engaging arm 22.

When the tubular portion 31 of the counterpart side connector 2 is inserted into the void 13 of the connector 1 (that is, when the connector 1 and the counterpart side connector 2 are fitted to each other), in the middle of the fitting, the engaging arm 22 is elastically deformed to be bent in the upward direction (an arrow Z1 direction illustrated in FIG. 5), and accordingly, the lock projection 34 of the counterpart side connector 2 goes into the lower side of the end portion including the free end 23 of the lock arm 20.

Figure 7:
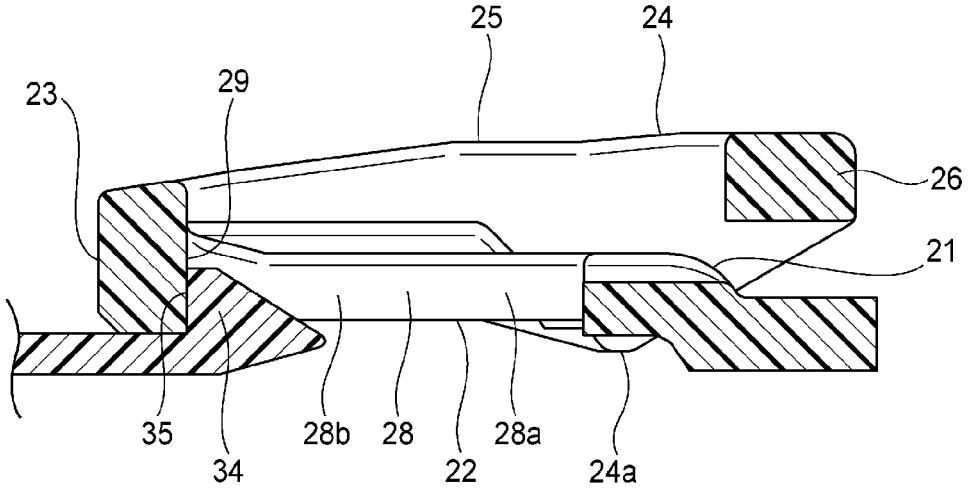
FIG. 7 is a view which corresponds to FIG. 5 in a state where fitting of the connector illustrated in FIG. 1 and the counterpart side connector illustrated in FIG. 6 is completed.

In addition, when the fitting between the connector 1 and the counterpart side connector 2 is completed, the position of the free end 23 returns to an initial position before the elastic deformation by a restoring force of the engaging arm 22. Accordingly, as illustrated in FIG. 7, the locking hole 28 and the locking projection 34 are engaged with each other, and the locking surface 29 of the locking hole 28 locks the locking surface 35 of the lock projection 34.

As a result, a state where the fitting between the connector 1 and the counterpart side connector 2 is completed is maintained. In a state where the fitting is completed, by connecting the terminal accommodated in the terminal accommodation portion 11 of the connector 1 and the terminal disposed on the inside of the tubular portion 31 of the counterpart side connector 2, the connector 1 and the counterpart side connector 2 are electrically connected to each other.

Meanwhile, as illustrated in FIG. 5, in a state where the fitting is completed, when the operation portion 26 of the releasing arm 24 is pressed downward (arrow Z2 direction), the releasing arm 24 rotates around a lower end portion 24*a* (which abuts against the surface (not illustrated) of the housing 10) of the releasing arm 24, and the free end 23 of the engaging arm 22 linked to the front end of the linking arm portion 25 rises upward (arrow Z1 direction). Accordingly, the engagement between the locking hole 28 and the lock projection 34 is released, and a state where the connector 1 and the counterpart side connector 2 can be separated from each other is achieved.

In addition, the pair of stoppers 27 provided in the pair of linking arm portions 25 can abut against one pair of interference portions 16 (refer to FIG. 2B) provided in the hood portion 12 of the connector 1. Accordingly, in a case where a force in the upward direction opposite to the arrow Z2 direction is applied to the operation portion 26, it is possible to prevent the linking arm portion 25 from being excessively displaced and damaged.

In the connector 1 according to the embodiment of the above-described invention, at the part on the rear side of the locking hole 28 of the engaging arm 22, the hole width enlarging portion 28*a* having a substantially trapezoidal shape of which the hole width gradually increases toward the front end side from the rear end side is formed, and at the part on the front side of the locking hole 28, the constant hole width portion 28*b* having a substantially constant rectangular shape of which the hole width is the width D1 is formed. Therefore, for example, compared to a case where the locking hole 28 has a substantially constant rectangular shape having the width D1 across the entire fitting direction, it is possible to prevent deterioration of strength of the periphery of the locking hole 28 in the engaging arm 22.

Furthermore, flexibility of the engaging arm 22 gradually changes depending on the place by the hole width enlarging portion 28*a* (that is, the stress is diffused when bending the engaging arm 22). Therefore, when performing the engagement releasing, concentration of stress is mitigated in the periphery or the like of the fixing end 21 of the engaging arm 22.

Furthermore, when adjusting a widening degree (inclination angle θ, refer to FIGS. 4A and 4B) of the hole width of the hole width enlarging portion 28*a*, it is possible to arbitrarily adjust the strength of the engaging arm 22. Therefore, when adjusting the widening degree of the hole width in accordance with the size of the lock projection 34 of the counterpart side connector 2, it is possible to maintain operability at the time of the engagement releasing regardless of the size of the lock projection 34.

According to the connector 1, the lock arm 20 which is elastically deformed when performing the engagement (when performing the fitting) and the engagement releasing is formed of a hydrolysis-resistant material. Therefore, it is possible to prevent damage of the lock arm 20 which is particularly likely to be damaged due to deterioration caused by the hydrolysis of the configuration material. As a result, in the connector 1, it is possible to prevent the damage of the lock arm 20 even in a case of being used for a long period of time under a high-temperature and high-humidity environment compared to a case where the lock arm 20 is not formed of the hydrolysis-resistant material.

<Other Aspects>

The invention is not limited to each of the embodiments, various modification examples can be employed within a range of the invention. For example, the invention is not limited to the above-described embodiments, and can be appropriately deformed or improved. In addition, in the above-described embodiment, the material, the shape, the dimension, the number, or the disposition location of each configuration elements are arbitrary as long as the invention can be achieved, and are not particularly limited.

For example, in the above-described embodiment, the hole width enlarging portion 28*a* having a substantially trapezoidal shape is formed at the part on the rear side of the locking hole 28 of the engaging arm 22, and the constant hole width portion 28*b* having a substantially rectangular shape is formed at the part on the front side of the locking hole 28. However, the hole width enlarging portion 28*a* having a substantially trapezoidal shape of which the hole width gradually increases toward the front end side from the rear end side may be formed across the entire region in the fitting direction of the locking hole 28.

Furthermore, in the above-described embodiment, the connector 1 (the housing 10 and the lock arm 20) is integrally molded by using a resin material formed of the hydrolysis-resistant material. However, for example, in an aspect in which the lock arm 20 molded to be separately and independently from the housing 10 is attached (bonded) to the housing 10, only the lock arm 20 which is elastically deformed when performing the engagement (when performing the fitting) and the engagement releasing may be molded by using the hydrolysis-resistant material, and the housing 10 may be molded by using polyester such as PBT.

Here, characteristics of the connector of the above-described embodiment according to the present invention are respectively briefly summarized and listed in the following (1) and (2).

(1) A connector (1) including: a housing (10); and a lock arm (20) which extends from the housing (10) and is engageable with a counterpart side connector (2), in which the lock arm (20) includes a first arm (22) which has a shape of a cantilever beam and has a locking hole (28) for being engaged with the counterpart side connector (2) in the vicinity of a free end (23), and a second arm (24) which extends from an end portion on the free end side of the first arm (22) and is capable of releasing the engagement by bending the first arm (22) around a fixing end (21) of the first arm (22), and the locking hole (28) has a hole shape (28*a*) of which the size in a width direction orthogonal to an extending direction of the first arm (22) increases at least at a part as approaching the free end (23) from the fixing end (21).

(2) The connector according to the above-described (1) in which the lock arm (20) is formed of a hydrolysis-resistant material.

What is claimed is:

1. A connector comprising:

a housing; and a lock arm that extends from the housing and is engageable with a lock projection of a counterpart connector, wherein the lock arm includes:

a first arm that has a shape of a cantilever beam and has a locking hole for being engaged with the counterpart connector at a free end of the first arm; and a second arm that extends from an end portion on the free end of the first arm and is capable of releasing the engagement by bending the first arm around a fixing end of the first arm, and the locking hole has a hole of which the size in a width direction orthogonal to an extending direction of the first arm becomes larger as the hole gets closer to the free end from the fixing end, wherein the hole of the locking hole has a pair of planar hole side surfaces inclined inward with respect to a fitting direction by a predetermined angle in accordance with a size of the lock projection.

2. The connector according to claim 1, wherein the lock arm is formed of a hydrolysis-resistant material.

3. The connector according to claim 1, wherein the hole has a hole width enlarging portion and a constant hole width portion.

4. The connector according to claim 3, wherein the hole width enlarging portion has a substantially trapezoidal shape formed at a part of the locking hole closer to the fixing end than the free end of the first arm, and the constant hole width portion has a substantially rectangular shape formed at a part closer to the free end than the fixing end of the locking hole.

5. The connector according to claim 4, wherein the hole width enlarging portion has a hole width that gradually increases toward the free end from the fixing end of the first arm and is formed across an entire region of the locking hole in the extending direction of the first arm.

6. The connector according to claim 1, wherein the pair of planar hole side surfaces extend at least halfway of a total length of the hole.

7. The connector according to claim 1, wherein the predetermined angle by which the pair of planar hold side surfaces are inclined inward with respect to the fining direction is less than 45 degrees.

* * * * *